US010660387B2

(12) United States Patent
Horner et al.

(10) Patent No.: US 10,660,387 B2
(45) Date of Patent: May 26, 2020

(54) LAYERED THUMBHOLE STRUCTURE

(71) Applicant: NIKE, Inc., Beaverton, OR (US)

(72) Inventors: Stewart D. Horner, Portland, OR (US); Iustinia Koshkaroff, Portland, OR (US); Matthew D. Nordstrom, Portland, OR (US); Derek Skorupski, Portland, OR (US)

(73) Assignee: NIKE, INC., Beaverton, OR (US)

( * ) Notice: Subject to any disclaimer, the term of this patent is extended or adjusted under 35 U.S.C. 154(b) by 343 days.

(21) Appl. No.: 15/404,957

(22) Filed: Jan. 12, 2017

(65) Prior Publication Data

US 2017/0119073 A1 May 4, 2017

Related U.S. Application Data

(63) Continuation-in-part of application No. 15/045,465, filed on Feb. 17, 2016, now Pat. No. 9,681,689.
(Continued)

(51) Int. Cl.
*A41B 7/00* (2006.01)
*A41B 1/08* (2006.01)
(Continued)

(52) U.S. Cl.
CPC ..... *A41D 27/10* (2013.01); *A41B 1/08* (2013.01); *A41B 7/00* (2013.01); *A41D 13/08* (2013.01); *A41D 19/0041* (2013.01)

(58) Field of Classification Search
CPC .... A41D 27/10; A41D 19/01; A41D 19/0041; A41D 13/08; A41D 19/0017; A41B 7/00;
(Continued)

(56) References Cited

U.S. PATENT DOCUMENTS 415,676 A 11/1889 Magee
948,142 A 2/1910 Karp
(Continued)

FOREIGN PATENT DOCUMENTS

CA 2989401 A1 * 8/2016 ..... A41B 1/08
WO 2005112677 A2 12/2005
(Continued)

OTHER PUBLICATIONS

Notice of Allowance dated Mar. 10, 2017 in U.S. Appl. No. 15/045,465, 15 pages.
(Continued)

*Primary Examiner* — Jameson D Collier
(74) *Attorney, Agent, or Firm* — Shook, Hardy & Bacon, LLP

(57) ABSTRACT

A tubular sleeve having a proximal end opposite a distal end, a cutout formed through the tubular sleeve proximate the distal end, a first panel having at least a trailing edge and spanning a first portion of the cutout, a second panel having at least a leading edge and a trailing edge and spanning a second portion of the cutout, and a third panel having at least a leading edge and spanning a third portion of the cutout. The second panel may overlap the first panel across the entire width of the cutout such that the second-panel leading edge is distal to the first-panel trailing edge. The third panel may overlap the second panel across the entire width of the cutout such that the third-panel leading edge is distal to the second-panel trailing edge. In some aspects, a mitten may be affixed to an interior surface of the tubular sleeve.

19 Claims, 12 Drawing Sheets

Related U.S. Application Data

(60) Provisional application No. 62/118,288, filed on Feb. 19, 2015, provisional application No. 62/242,760, filed on Oct. 16, 2015.

(51) Int. Cl.
*A41D 27/10* (2006.01)
*A41D 19/00* (2006.01)
*A41D 13/08* (2006.01)

(58) Field of Classification Search
CPC .... A41B 7/02; A41B 7/04; A41B 7/06; A41B 7/08; A41B 7/10; A41B 7/12; Y10S 2/917
USPC ..... 2/16, 59, 60, 123, 125, 270
See application file for complete search history.

(56) References Cited

U.S. PATENT DOCUMENTS

| | | | | |
|---|---|---|---|---|
| 1,012,648 | A | 12/1911 | Karp | |
| 1,338,098 | A | 4/1920 | Schneider | |
| 2,686,913 | A | 8/1954 | Brierley | |
| 2,803,824 | A | 8/1957 | Parish | |
| 3,496,572 | A | 2/1970 | Herzig | |
| 4,408,356 | A * | 10/1983 | Abrams | A41D 27/28 2/87 |
| 4,756,027 | A | 7/1988 | Buenos et al. | |
| 5,035,000 | A | 7/1991 | Matthias | |
| D319,113 | S | 8/1991 | Adams | |
| 5,097,534 | A | 3/1992 | Viemeister et al. | |
| 5,388,270 | A | 2/1995 | Hewitt | |
| 5,504,944 | A | 4/1996 | Bromer et al. | |
| 5,794,265 | A | 8/1998 | Reich | |
| 5,815,837 | A | 10/1998 | Christman et al. | |
| 5,867,825 | A | 2/1999 | Scheerer et al. | |
| 5,913,408 | A | 6/1999 | Shanahan | |
| 5,953,758 | A | 9/1999 | Foster | |
| 6,076,189 | A | 6/2000 | Christman et al. | |
| 6,122,772 | A | 9/2000 | De Guzman | |
| 6,253,381 | B1 * | 7/2001 | Kelley | A41D 3/02 2/125 |
| 6,449,772 | B1 | 9/2002 | Donner | |
| 6,996,847 | B2 | 2/2006 | Anderson et al. | |
| 7,168,098 | B2 | 1/2007 | West | |
| 7,310,825 | B2 | 12/2007 | St-Germain et al. | |
| 7,418,740 | B2 | 9/2008 | Anderson et al. | |
| 7,568,238 | B2 | 8/2009 | Schossberger et al. | |
| 8,479,313 | B2 * | 7/2013 | Jones | A41D 13/0005 2/16 |
| 8,601,612 | B2 | 12/2013 | Funk-Danielson | |
| 9,009,865 | B2 | 4/2015 | Gilreath | |
| 2006/0101554 | A1 | 5/2006 | St-Germain | |
| 2012/0174291 | A1 | 7/2012 | Fraze | |
| 2012/0233738 | A1 | 9/2012 | Blauer et al. | |
| 2014/0090144 | A1 | 4/2014 | Gilreath | |
| 2014/0157482 | A1 | 6/2014 | Blauer et al. | |
| 2014/0250565 | A1 | 9/2014 | Willows et al. | |
| 2015/0033451 | A1 | 2/2015 | Bradshaw | |
| 2016/0242474 | A1 * | 8/2016 | Baschak | A41D 13/0015 |
| 2016/0302502 | A1 * | 10/2016 | Beneyto-Ferre | A41D 27/285 |

FOREIGN PATENT DOCUMENTS

| | | | |
|---|---|---|---|
| WO | 2012085454 | A1 | 6/2012 |
| WO | 2015034722 | A1 | 3/2015 |
| WO | 2015131913 | A1 | 9/2015 |
| WO | 2016134159 | A1 | 8/2016 |

OTHER PUBLICATIONS

International Search Report and Written Opinion dated Mar. 27, 2018 in International Patent Application No. PCT/US2018/013437, 14 pages.

Intenational Preliminary Report on Patentability dated Aug. 31, 2017 in International Patent Application No. PCT/US2016/018493, 8 pages.

International Search Report and Written Opinion dated May 19, 2016 for PCT Application No. PCT/US2016/018493, 11 pages.

Allen, Dana, "Mountain Equipment Eclipse Hooded Zip Tee," blister, blistergearreview.com/gear-reviews/mountain-equipment-eclipse-hooded-zip-tee.

"Cyclic Zip Neck Women's," Arc'Teryx, arcteryx, © 2015, accessed: Aug. 2015. http://arcteryx.com/product.aspx?language=EN&gender=womens&category=shirts_and_tops&model=Cyclic-Zip-Neck-W.

JJ, "Ortovox Merino Fleece Hoody," YMMV Reviews, ymmvreviews.com, © 2015, accessed: Aug. 2015. http://ymmvreviews.com/clothing/ortovox-merino-fleece-hoody/.

"Trans4m™ Thermal Plus™ Run Glove," Amphipod, Inc., amphipod.com, © 2015, accessed: Aug. 2015. http://www.amphipod.com/products/trans4m-thermal-plus-run-glove.

Kitsilano, "Lululemon Pumpkin Orange Long Sleeve Turkey Trot Technical Running Shirt Top 205," goodoldlululemon.wordpress.com, Feb. 8, 2013. https://goodoldlululemon.wordpress.com/2013/02/08/lululemon-pumpkin-orangelong-sleeve-turkey-trot-technical-running-shirt-top-205/.

International Preliminary Report on Patentability dated Jul. 25, 2019 in International Patent Application No. PCT/US2018/013437, 9 pages.

* cited by examiner

LAYERED THUMBHOLE STRUCTURE

CROSS-REFERENCE TO RELATED APPLICATIONS

This application, entitled "Layered Thumbhole Structure," is a continuation-in-part of and claims priority to U.S. application Ser. No. 15/045,465, filed Feb. 17, 2016, entitled "Layered Thumbhole Structure," and further claims priority to U.S. Provisional Application 62/118,288, filed Feb. 19, 2015, entitled "Adaptive Material Garment System," and further claims priority to U.S. Provisional Application 62/242,760, filed Oct. 16, 2015, entitled "Layered Thumbhole Structure." The entireties of the aforementioned applications are incorporated by reference herein.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects described herein are directed towards a sleeve cuff having a thumbhole aperture formed between overlapping panels that can block, among other things, undesirable air flow into a sleeve when the aperture is not in use. The sleeve cuff is comprised of a distal panel (also referred to below as a distal strap) overlapping an anterior panel (also referred to below as an anterior patch). In an exemplary configuration, the distal panel and the anterior panel are affixed to a sleeve adjacent to, and covering at least a portion of, a cutout formed in the sleeve. The distal panel can span across the cutout and extend from a front edge (also referred to below as a leading edge) aligned with the end of the sleeve proximally up the sleeve to a back edge (also referred to below as a trailing edge). The anterior panel can be configured to cover at least a portion of the cutout. The anterior panel can include a back edge (also referred to as a trailing edge) and extend down the sleeve to a front edge (also referred to as a leading edge). For relational purposes, it is contemplated that the distal panel is affixed farther down the sleeve than the anterior panel.

It is contemplated that the configuration of the distal panel and the anterior panel can change, depending on whether the aperture is in an opened configuration (e.g., due to insertion of a thumb) or in a closed configuration, as will be described herein in more detail. In a closed configuration, the distal panel overlaps a portion of the anterior panel such that the distal panel back edge is located proximally up the sleeve from the anterior panel front edge. It is contemplated that either the anterior panel or the distal panel may be on top of the other at the overlapping portion. When in the closed configuration, permeability to the elements can be dramatically reduced. When in an opened configuration, the distal panel back edge overlaps a portion of the anterior panel (moving laterally across the anterior panel) between a first anterior panel side edge and a first point of intersection, and between a second anterior panel side edge and a second point of intersection. The first and second points of intersection refer to the intersections between the anterior panel front edge and the distal panel back edge. It is this offset design that provides a snug fit around a thumb that reduces air and environmental permeability when a thumb is received. In this open configuration, the anterior panel front edge is separated from the distal panel back edge and the aperture forms a snug fit around a received thumb between the first point of intersection and the second point of intersection. The perimeter of the aperture comprises a portion of the anterior panel front edge and a portion of the distal panel back edge.

Aspects described herein may further relate to a method of manufacturing a sleeve having a sleeve cuff in accordance with aspects described herein. In an exemplary aspect, the method may comprise the steps of providing a sleeve, providing an anterior panel, and providing a distal panel. The sleeve has a first end distally located from a torso end and having a hand opening thereat. The sleeve further comprises a cutout formed in a wall of the sleeve. In one aspect, the cutout has one or more edges. The distal panel has a back edge and at least one front edge. The anterior panel has a front edge and one or more back edges. The method further comprises the step of affixing the distal panel to the sleeve such that the distal strap spans the cutout. In one aspect, a distal panel front edge is aligned with the end of the sleeve. The method further comprises the step of affixing the anterior panel to the sleeve at the one or more back edges such that the anterior panel covers at least a portion of the cutout in the sleeve and such that the distal panel back edge overlaps at least a portion of the anterior panel. The overlapping distal panel and anterior panel present an aperture. The aperture has a perimeter comprised of at least a portion of the distal panel and at least a portion of the anterior panel. The method may further comprise the step of forming a cutout in the sleeve.

Another aspect described herein may relate to a tubular sleeve having a distal end opposite a proximal end. A cutout may be formed through the tubular sleeve proximate the distal end. The cutout may be defined in part by a first cutout edge and a second cutout edge, wherein the first cutout edge is positioned across the cutout from the second cutout edge. The tubular sleeve may further comprise a first panel having at least a trailing edge, a second panel having at least a leading edge and a trailing edge, and a third panel having at least a leading edge. The first panel may be affixed to the tubular sleeve to span a first portion of the cutout, the second panel may be affixed to the tubular sleeve to span a second portion of the cutout, and the third panel may be affixed to the tubular sleeve to span a third portion of the cutout. The second-panel leading edge may overlap the first-panel trailing edge to define at least a portion of a first aperture. The first aperture may be in communication with an interior volume of the tubular sleeve. The third-panel leading edge may overlap the second-panel trailing edge to define at least a portion of a second aperture. The second aperture may be in communication with the interior volume of the tubular sleeve.

The tubular sleeve may further comprise an inner surface defining the interior volume of the tubular sleeve and a mitten affixed to the inner surface. In some aspects, the first-panel trailing edge is parallel to the distal end of the tubular sleeve. In other aspects the tubular sleeve may further comprise each of the first panel, the second panel, and the third panel having a first side edge affixed to the tubular sleeve at the first cutout edge and a second side edge affixed to the tubular sleeve at the second cutout edge. The first-panel first side edge and the first-panel second side edge may each extend from the first-panel trailing edge towards the distal end of the tubular sleeve. The second-panel first side edge and the second-panel second side edge may each extend from the second-panel trailing edge towards the distal end of the tubular sleeve. The second-panel first side edge and the second-panel second side edge extension from the second-panel trailing edge may terminate at the second-panel leading edge. The third-panel first side edge and the third-panel second side edge may each extend from the third-panel leading edge towards the proximal end of the tubular sleeve. In some aspects, each respective first side edge is the same length as the respective second side edge. In further aspects, at least one of the first panel, the second panel, and the third panel integrally extends from the tubular sleeve.

Yet another aspect described herein may relate to a tubular sleeve comprising a distal end opposite a proximal end. A cutout may be formed through the tubular sleeve proximate to the distal end. The cutout may be defined in part by a first cutout edge and a second cutout edge. The first cutout edge may be positioned across the cutout from the second cutout edge. The tubular sleeve may further comprise a first panel having at least a first side edge, a second side edge and a trailing edge. The first side edge of the first panel may be affixed to the tubular sleeve at a first seam extending along the first cutout edge. The second side edge of the first panel may be affixed to the tubular sleeve at a second seam extending along the second cutout edge. The tubular sleeve may further comprise a second panel having at least a first side edge, a second side edge, a leading edge and a trailing edge. The first side edge of the second panel may be affixed to the tubular sleeve at the first seam and the second side edge of the second panel may be affixed to the tubular sleeve at the second seam such that the leading edge of the second panel overlaps the trailing edge of the first panel. The tubular sleeve may further comprise a third panel having at least a first side edge, a second side edge and a leading edge. The first side edge of the third panel may be affixed to the tubular sleeve at the first seam and the second side edge of the third panel may be affixed to the tubular sleeve at the second seam such that the leading edge of the third panel overlaps the trailing edge of the second panel.

In some aspects, the first-panel first side edge may be the same length as the first-panel second side edge. In other aspects, the second-panel leading edge may extend in parallel to the second-panel trailing edge. In yet other aspects, the entire cutout may be covered by the first panel, the second panel, and the third panel.

Yet another aspect described herein may relate to a tubular sleeve comprising a cylindrical wall extending axially between a distal end and a proximal end of the tubular sleeve. The cylindrical wall may have an inner surface enclosing an interior volume and an outer surface opposite the inner surface. A cutout may extend through a portion of the cylindrical wall from the outer surface to the inner surface, proximate to the distal end. A first panel may span the cutout and have at least a trailing edge. A second panel may span the cutout and have at least a leading edge and a trailing edge. The second panel may be affixed to the tubular sleeve such that the leading edge of the second panel overlaps the trailing edge of the first panel and defines at least a portion of a distal thumbhole. A third panel may span the cutout and have at least a leading edge. The third panel may be affixed to the tubular sleeve such that the leading edge of the third panel overlaps the trailing edge of the second panel and defines at least a portion of a proximal thumbhole. A mitten may be affixed to the inner surface proximate the distal end of the tubular sleeve.

In some aspects, the mitten may comprise a panel having a perimeter and may be affixed to the inner surface along a portion of the perimeter. The unaffixed portion of the perimeter may present an aperture allowing communication with an interior portion of the mitten. The aperture may open towards the proximal end of the tubular sleeve. The proximal and distal thumbholes may each be configured to move between a closed configuration and an open configuration. The closed configuration of the distal thumbhole may comprise the second-panel leading edge overlapping at least a portion of the first panel across an entire width of the cutout. The closed configuration of the proximal thumbhole may comprise the third panel overlapping at least a portion of the second panel across an entire width of the cutout. The cutout may have a first cutout edge opposite a second cutout edge. The open configuration of the distal thumbhole may comprise the second-panel leading edge overlapping a portion of the first panel from the first cutout edge to a first point of intersection and from the second cutout edge to a second point of intersection. The first and second points of intersection both being between the first and second cutout edges, in accordance with some aspects. The open configuration of the proximal thumbhole may comprise the third-panel leading edge overlapping a portion of the second panel from the first cutout edge to a first point of intersection and from the second cutout edge to a second point of intersection. The first and second points of intersection both being between the first and second cutout edges, in accordance with some aspects.

BRIEF DESCRIPTION OF THE DRAWINGS

Examples of the present invention are described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed, unless and except when the order of individual steps is explicitly stated.

The terms of location used in this disclosure related to a sleeve extending from a torso portion of an article of apparel shall have their traditional meanings. A point on the sleeve is proximal to a second point if it is farther up the sleeve (e.g., closer to the torso portion) in the axial direction of sleeve extension. A point on the sleeve is distal to a second point if it is farther down the sleeve (e.g., farther from the torso portion) in the axial direction of sleeve extension. The location term "lateral" as used in connection with the sleeve may include a planar direction normal to the axial direction of sleeve extension.

The terms "overlap," "overlaps," or "overlapping" (etc.) when used in this disclosure (e.g., "the distal strap overlaps the anterior patch") include both overlapping "on top of" and "beneath." In terms of the example, the distal strap may overlap the anterior patch such that the distal strap overlaps on top of the anterior patch or the distal strap may overlap the anterior patch such that the distal strap overlaps beneath the anterior patch.

Figure 1:
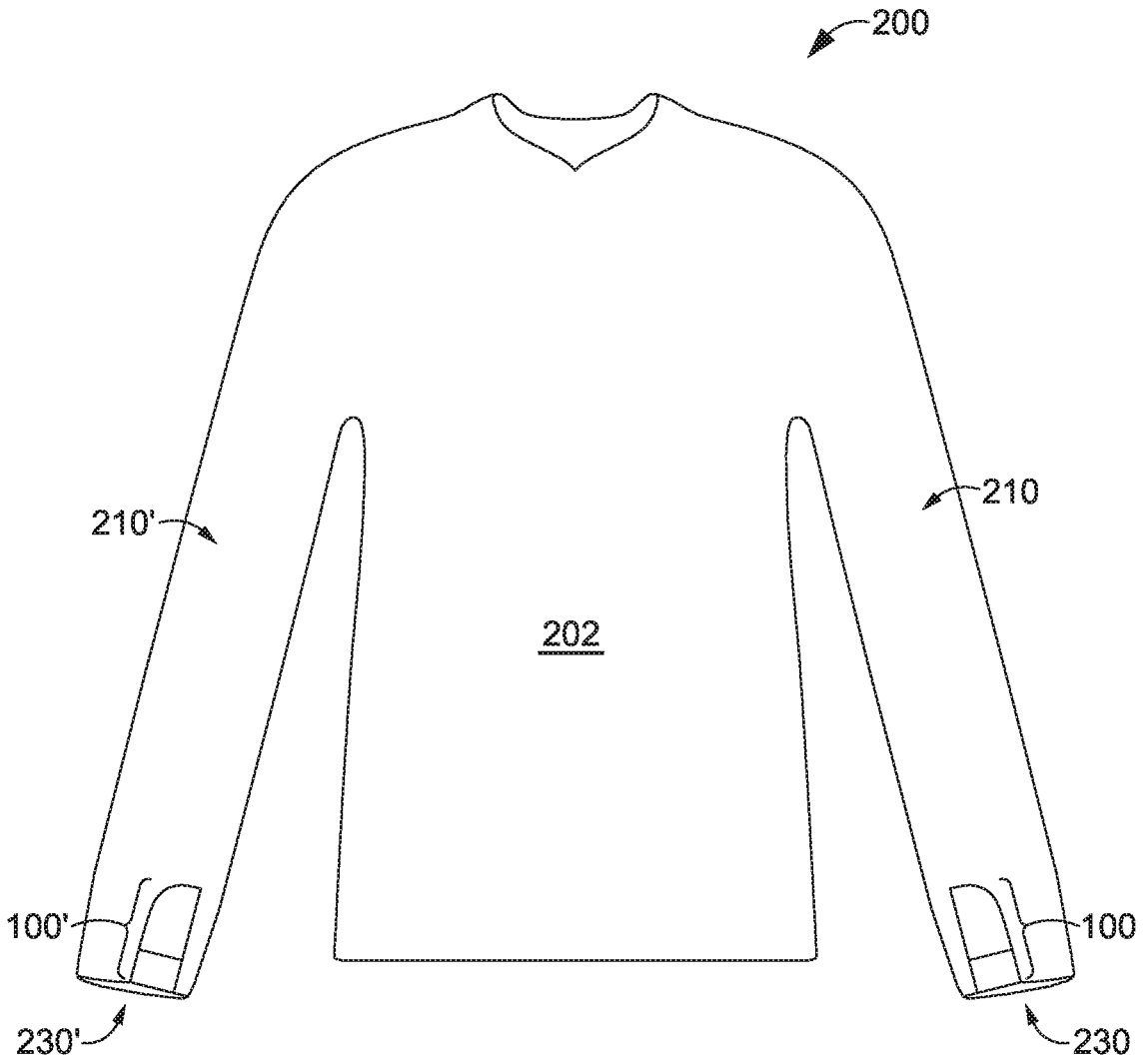
FIG. 1 illustrates a front elevation view of an exemplary article of apparel having sleeve cuffs affixed to distal sleeve ends on the article in accordance with an aspect described herein.

Turning now to FIG. 1, illustrated is a shirt 200 having a torso portion 202, a left sleeve 210, a right sleeve 210', each of the sleeves 210 and 210' extending distally away from the torso portion 202 and terminating at distal sleeve ends 230 and 230', respectively. Each sleeve may include a sleeve cuff 100 and 100', respectively, as depicted in FIG. 1. It is to be understood that the remaining disclosure describes the sleeve cuff 100 in relation to the left sleeve 210 and the distal sleeve end 230. As understood by those having skill in the art, however, this disclosure equally applies to the sleeve cuff 100' in relation to the right sleeve 210' and the distal sleeve end 230'. The remainder of this disclosure shall reference a sleeve 210.

Figure 2A:
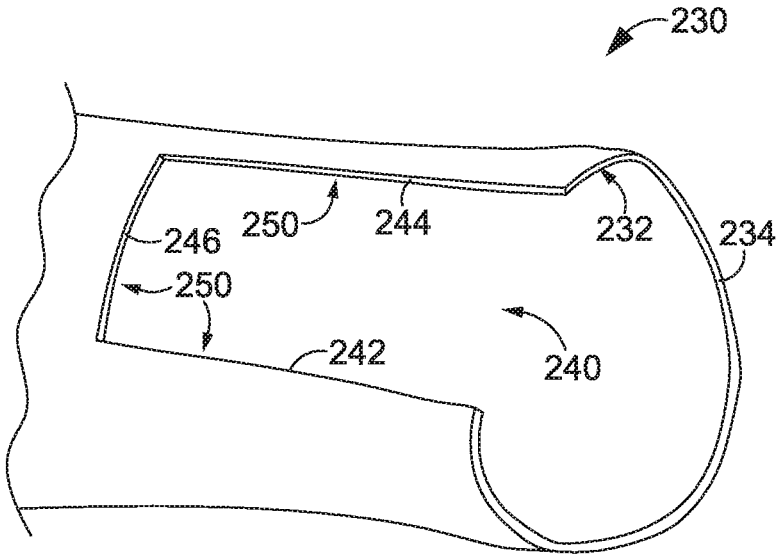
FIG. 2A illustrates a detail view of a distal sleeve end without a sleeve cuff affixed thereto in accordance with an aspect described herein.
Figure 2B:
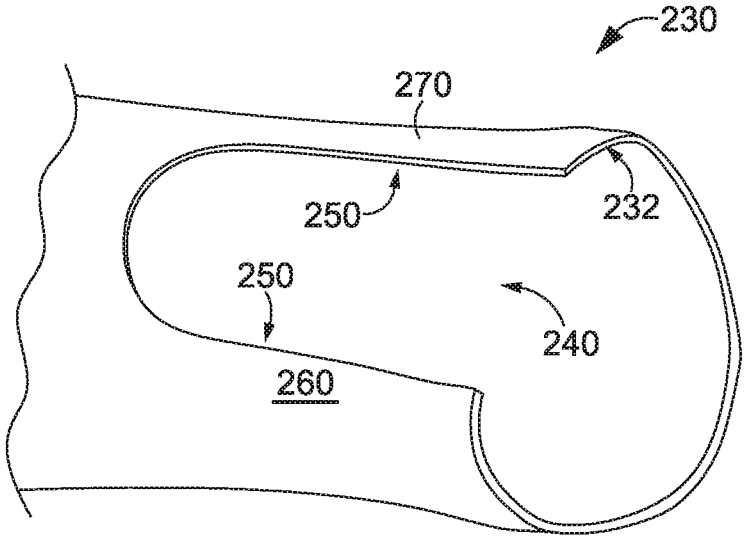
FIG. 2B illustrates a detail view of an alternative distal sleeve end without a sleeve cuff affixed thereto in accordance with an aspect described herein.

FIG. 2A depicts a distal sleeve end 230 of the sleeve 210 without the sleeve cuff 100 affixed thereto. The distal sleeve end 230 comprises a sleeve wall 232 extending proximally up the sleeve from a distal edge 234. The sleeve wall 232 includes a cutout 240 formed therein. The cutout 240 may extend from the distal edge 234 proximally up the sleeve 210. The cutout 240 further comprises at least one cutout edge 250. The at least one cutout edge 250 may comprise a first cutout edge 242, a second cutout edge 244, and a rear cutout edge 246 as depicted in FIG. 2A. The distal sleeve end 230 further comprises a first outer surface 260 and a second outer surface 270 (as illustrated in FIG. 2B), each outer surface being located adjacent to the cutout 240. In some aspects, the first cutout edge 242, the second cutout edge 244, and the rear cutout edge 246 may be a single edge comprising the at least one cutout edge 250.

In another aspect, the cutout 240 may be formed proximally up the sleeve 210 from the distal edge 234. In this aspect, the cutout 240 comprises a hole formed in the sleeve wall 232 and the cutout 240 is bounded by the sleeve wall 232 on all sides. In this aspect, the at least one cutout edge 250 may further comprise a front cutout edge. The front cutout edge and the distal edge 234 form a margin at the distal sleeve end 230.

In another aspect illustrated in FIG. 2B, the distal sleeve end 230 includes a cutout 240 formed in a sleeve wall 232. The cutout 240 extends proximally up the sleeve 210 and includes the at least one cutout edge 250. Spaced apart by the cutout 240 are the first outer surface 260 and the second outer surface 270.

Figure 3:
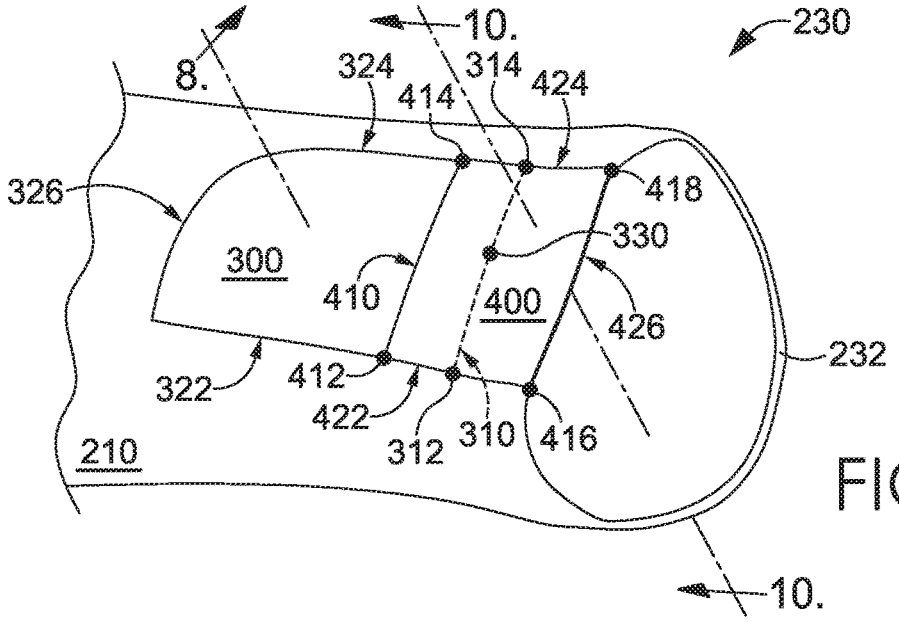
FIG. 3 illustrates a detail view of a sleeve cuff in a closed configuration in accordance with an aspect described herein.
Figure 4:
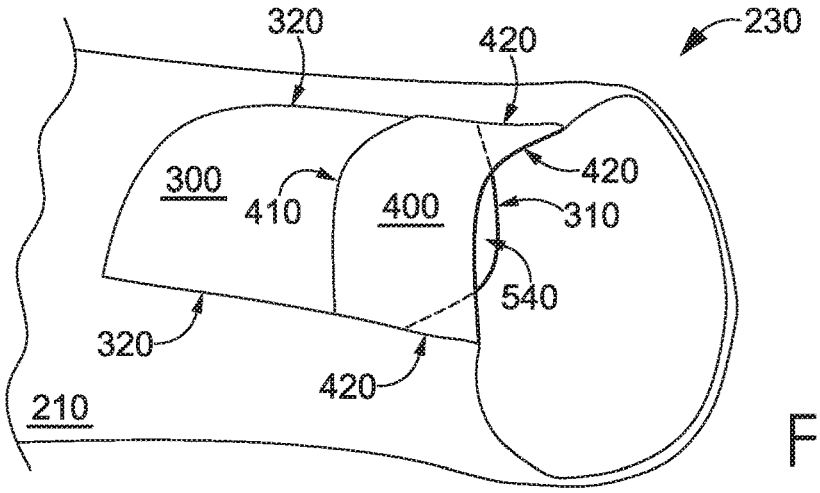
FIG. 4 illustrates a detail view of a sleeve cuff with a distal strap and an anterior patch separated while in the closed configuration in accordance with an aspect described herein.
Figure 5:
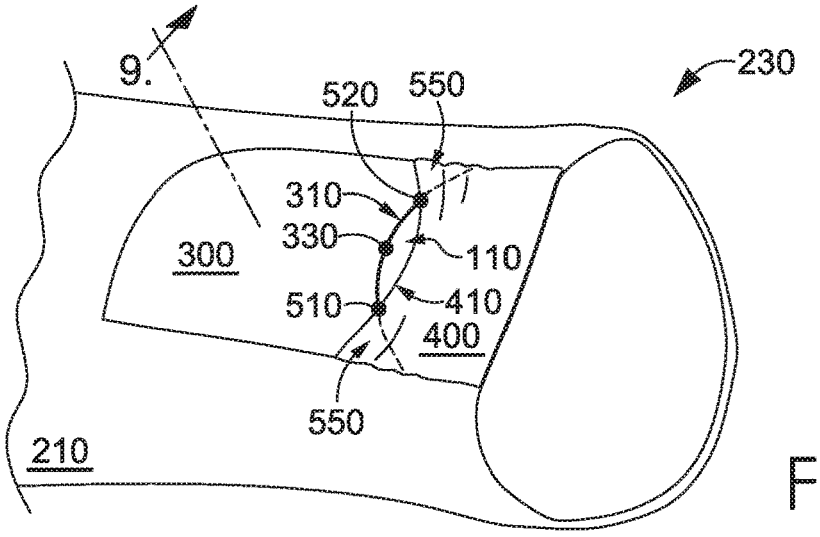
FIG. 5 illustrates a detail view of a sleeve cuff in an opened configuration in accordance with an aspect described herein.

Referring now to FIGS. 3-5, the sleeve cuff 100 further comprises an anterior patch 300 affixed to the sleeve 210. The anterior patch 300 is shown having a leading edge 310 and a plurality of trailing edges 320. In another aspect, the anterior patch 300 may have a leading edge 310 and a single trailing edge extending from one side to the other side of the leading edge 310, the anterior patch 300 extending there-between. The leading edge 310 extends laterally across the cutout 240 from a first anchor point 312 associated with the first outer surface 260 to a second anchor point 314 associated with the second outer surface 270. In another aspect, the leading edge 310 may extend between a first anchor point 312 associated with a first cutout edge 242 to a second anchor point 314 associated with a second cutout edge 244. The plurality of trailing edges 320 are located proximally up the sleeve from the leading edge 310, and the anterior patch 300 extends there-between. In the aspect illustrated by FIG.

3, the plurality of trailing edges includes a first side edge 322, a second side edge 324, and a rearward edge 326.

The anterior patch 300 may be affixed to the sleeve 210 atop or below the sleeve wall 232, within the cutout 240 to the at least one cutout edge 250 or in combination thereof. In another aspect, at least one first seam may affix the anterior patch 300 to the sleeve 210. In one aspect, the anterior patch 300 is affixed to the sleeve 210 from the first anchor point 312 around the cutout 240 located proximally to the leading edge 310 at each of the plurality of trailing edges 320 and to the second anchor point 314. In the aspect illustrated by FIG. 3, the anterior patch 300 is affixed adjacent to the rear cutout edge 246 at the rearward edge 326. As further illustrated in FIG. 3, the anterior patch 300 extends distally down the sleeve 210 from the rearward edge 326 to the leading edge 310 and the first and second side edges 322 and 324 are affixed adjacent to the first and second cutout edges 242 and 244, respectively, from the rearward edge 326 to the first and second anchor points 312 and 314, respectively. In one aspect, the anterior patch 300 may cover at least a portion of the cutout 240. The term "cover" is not meant to imply a limitation that the anterior patch 300 must be atop the sleeve 210; to the contrary, the anterior patch 300 may be atop or below the sleeve 210 or within the cutout 240 and prevent communication through the portion of the cutout 240 that is "covered."

The sleeve cuff 100 further comprises a distal strap 400. In one aspect, the distal strap 400 includes a trailing edge 410 and a plurality of leading edges 420 and extends there-between. In another aspect, the distal strap 400 may include a trailing edge 410 and a single leading edge. In the aspect illustrated in FIG. 3, the plurality of leading edges 420 include a first side edge 422, a second side edge 424, and a front edge 426. In one aspect, the trailing edge 410 extends across the cutout 240 from a first anchor point 412 to a second anchor point 414. In the aspect depicted in FIG. 3, the front edge 426 extends laterally across the cutout 240 from a third anchor point 416 to a fourth anchor point 418. In any aspect depicted in FIG. 3, the distal strap 400 spans the cutout 240 and is affixed to the sleeve 210 such that the first side edge 422 is affixed to the first outer surface 260 and the second side edge 424 is affixed to the second outer surface 270. The distal strap 400 may be oriented to have a long length dimension extend laterally around the sleeve and a short width dimension extend axially up the sleeve. In the aspect illustrated in FIG. 3, the front edge 426 is not affixed to the sleeve 210. In this aspect, the front edge 426 may be laterally aligned with the distal edge 234. In another aspect, where the cutout 240 may be spaced proximally up the sleeve 210 from the distal edge 234, the front edge 426 may be affixed to the sleeve 210 adjacent to the forward cutout edge.

The exemplary distal strap 400 illustrated in FIG. 3 extends laterally across the cutout 240 between the first side edge 422 and the second side edge 424 and proximally up the sleeve 210 from the front edge 426 to the trailing edge 410. In the illustrated aspect, the sleeve cuff 100 is in a closed configuration and the distal strap trailing edge 410 is proximally located up the sleeve from the anterior patch leading edge 310; stated another way, the distal strap 400 overlaps the anterior patch 300.

The distal strap 400 may be affixed atop the sleeve 210, below the sleeve 210, within the cutout 240, or in some combination thereof. In one aspect, the distal strap 400 is affixed to the distal sleeve end 230 at the first outer surface 260 and the second outer surface 270. In another aspect, the at least one first seam may affix the distal strap 400 to the sleeve 210. In yet another aspect, a second seam may affix the distal strap 400 to the sleeve 210. In one aspect, the distal strap 400 is affixed to the sleeve 210 along the first side edge 422 from the first anchor point 412 to the third anchor point 416 and along the second side edge 424 from the second anchor point 414 to the fourth anchor point 418.

When the shirt 200 is in the as-worn position (i.e., when the shirt 200 is donned by a wearer), the sleeve cuff 100 presents a plurality of configurations. In one aspect, the plurality of configurations includes at least the closed configuration and an opened configuration. The closed configuration is best seen in FIG. 3. The opened configuration may be seen in FIGS. 6-8. In one aspect, the closed configuration is defined by the distal strap 400 overlapping the anterior patch 300 such that the distal strap trailing edge 410 is located proximally up the sleeve 210 from the anterior patch leading edge 310. The closed configuration is typically presented when the sleeve is in the as-worn position and a thumb is not received through the aperture 110.

One aspect of the open configuration illustrated in FIG. 5 includes the aperture 110 presented between a first point of intersection 510 and a second point of intersection 520. The points of intersection 510 and 520 are defined by the points where the distal strap trailing edge 410 intersects the anterior patch leading edge 310.

In the aspect illustrated in FIG. 5, when the sleeve cuff 100 is in the open configuration, the sleeve cuff 100 may include an overlapping portion 550 where the distal strap 400 overlaps the anterior patch 300 between the first cutout edge 242 and the first point of intersection 510. The sleeve cuff 100 in the open configuration further includes the aperture 110 between the first point of intersection 510 and the second point of intersection 520. In one aspect, a perimeter of the aperture 110 is comprised of a portion of the distal strap trailing edge 410 and a portion of the anterior patch leading edge 310. The sleeve cuff 100 in the open configuration may further include a second overlapping portion where the distal strap 400 overlaps the anterior patch 300 between the second point of intersection 520 and the second cutout edge 244.

FIG. 4 depicts the exemplary sleeve cuff 100 of FIG. 3 with the distal strap 400 and the anterior patch 300 separated while still in the closed configuration in accordance with an aspect hereof. As can be understood, the separation of the anterior patch 300 and distal strap 400 in the manner depicted in FIG. 4 does not provide a hole through which a user's thumb may extend as a thumb will extend along the inner surface of the anterior patch 300 past the trailing edge 410 of the distal strap 400 which prevents, based on traditional human anatomy, the thumb from accidentally extending through the aperture 110, in an exemplary aspect. Therefore, a gap 540 may be formed between the distal strap 400 and the anterior patch 300 without eliminating an overlap near the midpoint of the leading edge 310.

FIG. 5 depicts the sleeve cuff 100 in an open configuration at the aperture 110 in accordance with aspects described herein. In this example, a center point 330 is not overlapped by the distal strap 400. The leading edge 310 is overlapped by the distal strap 400 trailing edge 410 near the first and second side edges 322 and 324. However, the leading edge 310 intersects the trailing edge 410, at the first and second points of intersection 510 and 520, causing the center point 330 to be spaced apart from the distal strap 400 and to form the aperture 110. Stated differently, it is contemplated that the aperture 110 is defined by the leading edge 310 and the trailing edge 410 between a first point of intersection 510 and a second point of intersection 520 of the same edges.

The perimeter of the aperture 110 may include at least a portion of the leading edge 310 and at least a portion of the trailing edge 410.

Figure 6:
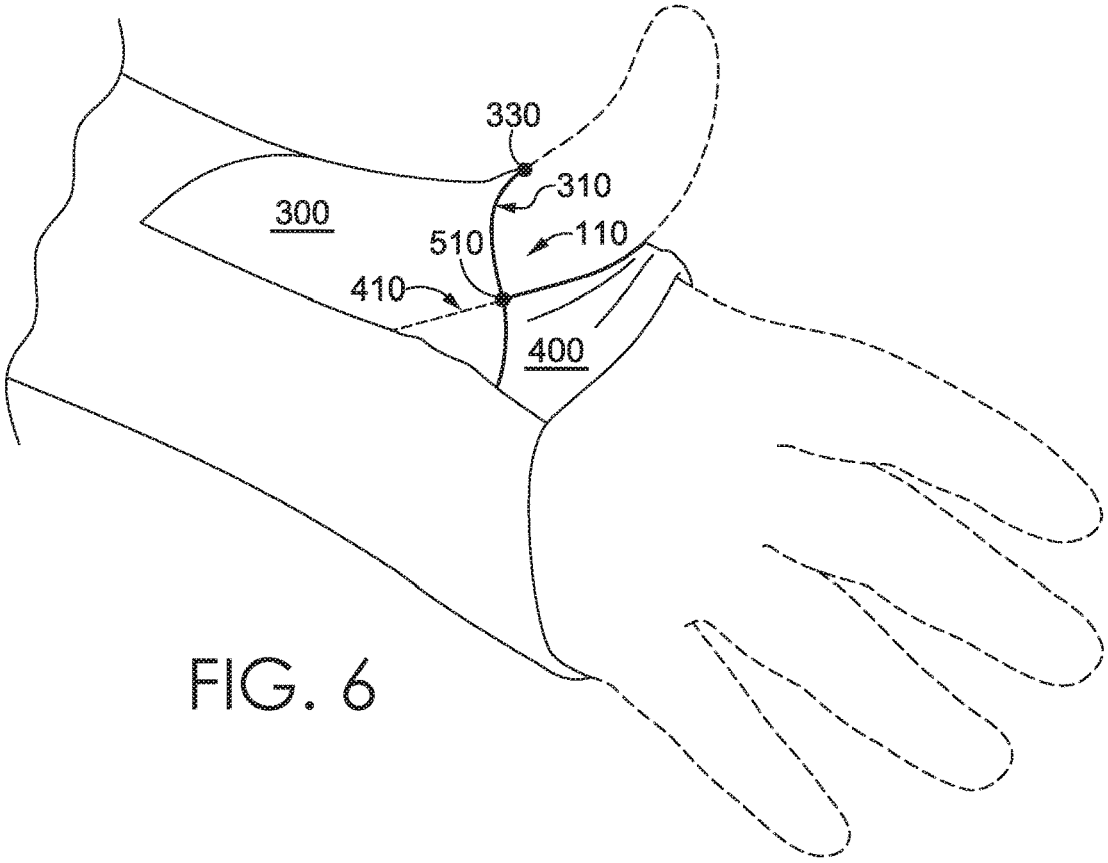
FIG. 6 illustrates a detail view of a sleeve cuff having a thumb extending through an aperture in accordance with an aspect described herein.

FIG. 6 illustrates an alternative aspect of the present invention where the anterior patch 300 overlaps the distal strap 400 on the exterior side of the sleeve 210 (from FIG. 3). Hence, when viewed from outside the sleeve 210, the anterior patch 300 is on top of the distal strap 400 where the items overlap.

Figure 7:
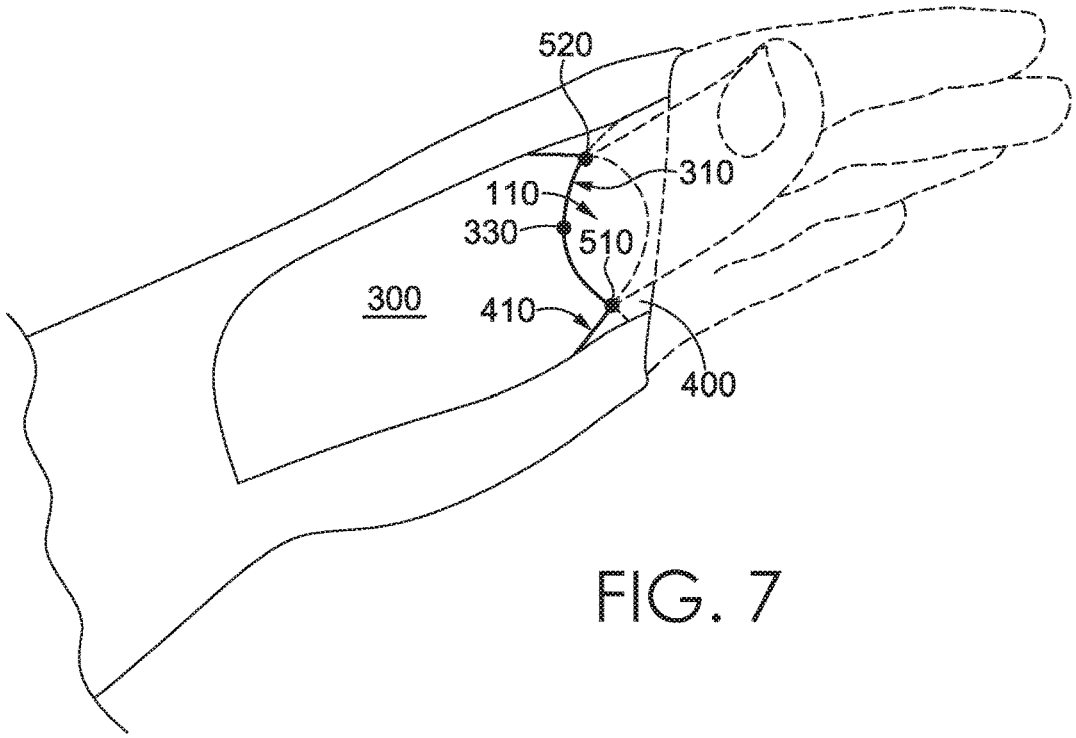
FIG. 7 illustrates a detail view of a sleeve cuff having a thumb extending through an aperture in accordance with an aspect described herein.

FIG. 6 and FIG. 7 depict the sleeve cuff 100 in the open configuration and having a thumb received through the aperture 110 in accordance with aspects described herein. As can be illustrated with a thumb extending therethrough, the aperture 110 is formed, in an exemplary aspect, by the leading edge 310 extending radially outward from an axial centerline of the sleeve 210 when in the open configuration. To facilitate transitioning from a closed to an open configuration, and to allow for freedom of movement of the thumb, it is contemplated that the distal strap 400 and/or the anterior patch 300 are formed from an elastic material that allows for the manipulation of the trailing edge 410 and the leading edge 310 to open and move about a thumb.

Varying the materials used to form the distal strap 400 and/or the anterior patch 300 may provide for additional control of the elasticity provided at the distal sleeve end 230. In one aspect, the distal strap 400 and/or the anterior patch 300 may be comprised of a woven material. In another aspect, the distal strap 400 and/or the anterior patch 300 may be comprised of an engineered knit material. In some aspects, the sleeve 210 can be comprised of materials having lower elasticity than the materials in the sleeve cuff 100. In those aspects, including the sleeve cuff 100 in the sleeve 210 allows the wearer to pull the sleeve 210 up their arm such that the distal sleeve end 230 is positioned proximally up the wearer's arm. Further, the net elasticity of the distal sleeve end 230 and the sleeve cuff 100 may be operable to hold the distal sleeve end 230 at the proximally located position of the wearer's arm.

Figure 8:
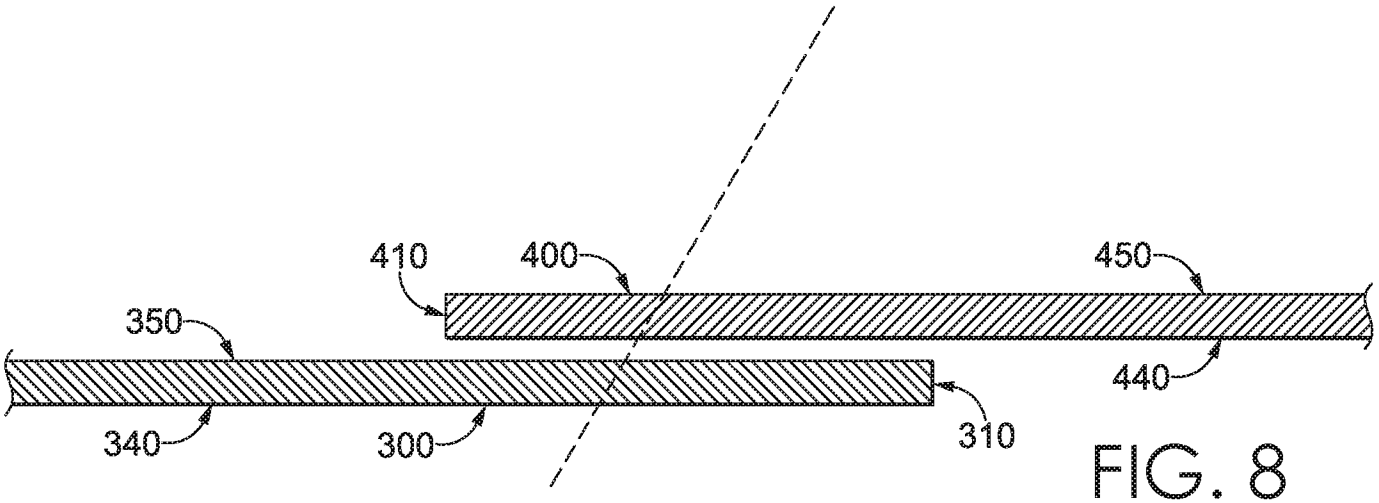
FIG. 8 depicts a cross-section taken along 8-8 of FIG. 3 and illustrates a sleeve cuff in a closed configuration in accordance with an aspect described herein.

FIG. 8 depicts a cross-section of a sleeve cuff 100 in a closed configuration, in accordance with aspects described herein. The distal strap 400 is comprised of an inner surface 440 and an outer surface 450. The anterior patch 300 is comprised of an inner surface 340 and an outer surface 350. As depicted, the distal strap 400 trailing edge 410 overlaps the anterior patch 300. A dash line is provided to depict an exemplary angle of thumb insertion to open the thumbhole by changing the relative placement of the trailing edge 410 relative to the leading edge 310 as depicted in FIG. 9.

Figure 9:
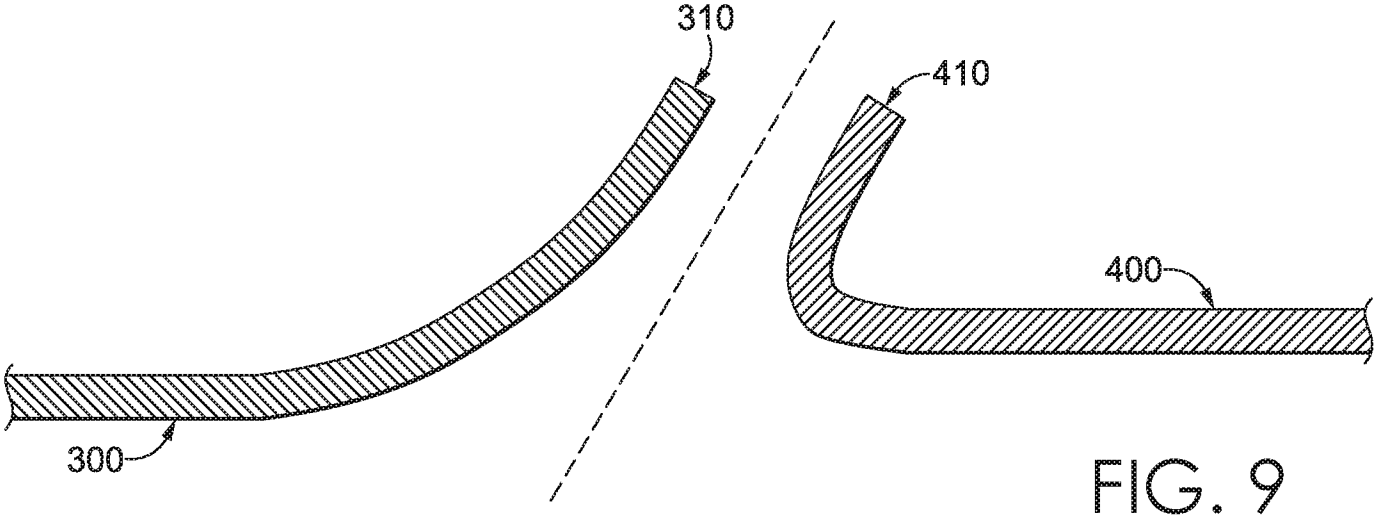
FIG. 9 depicts a cross-section taken along 9-9 of FIG. 5 and illustrates a sleeve cuff in an opened configuration in accordance with an aspect described herein.

FIG. 9 depicts a cross-section of the sleeve cuff 100 in the opened configuration, in accordance with aspects described herein. The open configuration allows a thumb having an angle of entry depicted by the dash line to exit an internal volume of the sleeve 210.

The sleeve cuff 100 has hereinabove been disclosed as having the distal strap 400 overlapping the anterior patch 300. It is contemplated, however, that in one exemplary aspect the anterior patch 300 overlaps the distal strap 400. In this aspect, the anterior patch leading edge 310 overlaps the distal strap and is distally located down the sleeve 210 from the distal strap trailing edge 410. This aspect further comprises the aperture 110 formed between the overlapping anterior patch 300 and distal strap 400 and having a perimeter including at least a portion of each of the leading edge 310 and the trailing edge 410.

Figure 10:
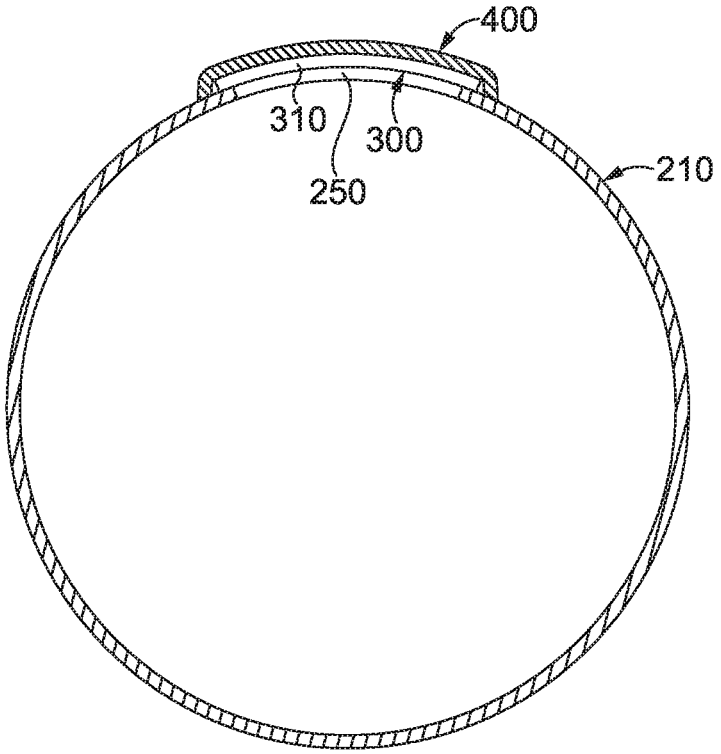
FIG. 10 depicts a cross-section taken along 10-10 of FIG. 3 and illustrates a sleeve cuff affixed to sleeve surfaces on opposite sides of a cutout and in a closed configuration in accordance with an aspect described herein.

FIG. 10 depicts a lateral cross-section of the sleeve cuff 100 across line 10-10 in FIG. 3, the line 10-10 being coplanar with the anterior patch leading edge 310. The distal strap 400 is shown overlapping the anterior patch 300 and the sleeve cuff 100 is in the closed configuration. It is understood that the anterior patch 300 is affixed at the inner surface 340 to the sleeve wall 232 at the first and second outer surfaces 260, 270. Further, it is understood that the distal strap 400 is similarly affixed at the distal strap inner surface 440 to the sleeve wall 232 at the first and second outer surfaces 260, 270.

Figure 11:
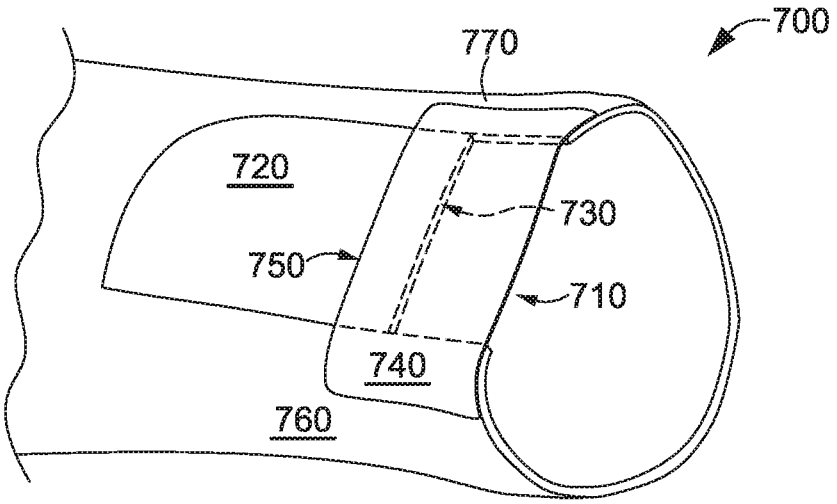
FIG. 11 illustrates a detail view of a sleeve cuff with a distal strap affixed to sleeve surfaces on opposite sides of a cutout and an anterior patch affixed within the cutout to opposing cutout edges and in a closed configuration in accordance with an aspect described herein.

FIG. 11 depicts another aspect of the distal sleeve end 700 in a closed configuration in accordance with an aspect hereof. Depicted is a distal sleeve end 700 having a cutout 710. The cutout 710 includes an anterior patch 720 affixed around and adjacent to the cutout 710 at the points proximally located up the sleeve from a leading edge 730. The distal sleeve end 700 further includes a distal strap 740 having a trailing edge 750, the distal strap 740 being affixed at a first sleeve surface 760 and a second sleeve surface 770. The trailing edge 750 is located proximally up the sleeve from the anterior patch leading edge 730. As depicted, the distal strap 740 is wider than the cutout 710 and is also wider than the anterior patch 720. In one aspect, the distal strap 740 is affixed to the sleeve on both sides of the cutout 710 but not at points adjacent to the cutout 710. In another aspect, the sleeve integrates the anterior patch 720 therein such that the leading edge 730 forms a rear wall of the cutout 710. In this aspect, the distal strap trailing edge 750 is proximally located up the sleeve from the anterior patch leading edge 730. In yet another aspect, the distal strap 740 may be similarly integrated into the distal sleeve end 700 and the anterior patch 720 is affixed to the sleeve such that the distal strap trailing edge 750 overlaps the anterior patch leading edge 730.

Figure 12:
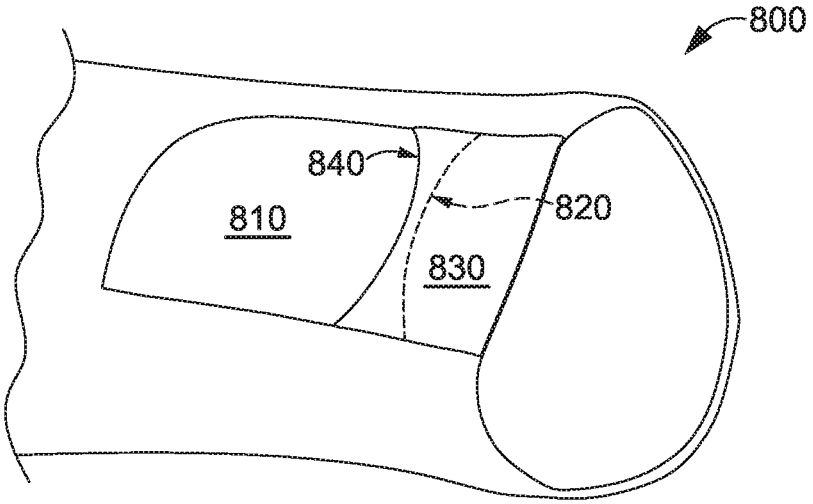
FIG. 12 illustrates a detail view of a sleeve cuff with an angular distal strap trailing edge and an angular anterior patch leading edge in accordance with an aspect described herein.

FIG. 12 depicts a distal sleeve end 800 in a closed configuration having an anterior patch 810 and a distal strap 830 affixed over a cutout. In one aspect, the distal strap 830 includes a trailing edge 840 having an arcuate shape. In this aspect, the anterior patch 810 has a leading edge 820 having an arcuate shape. The distal strap 830 may be positioned such that the distal strap 830 overlaps the anterior patch 810 and the arcuate trailing edge 840 is positioned proximally up the sleeve from the arcuate leading edge 820 and there are no points of intersection between the arcuate trailing edge 840 and the arcuate leading edge 820.

Figure 13:
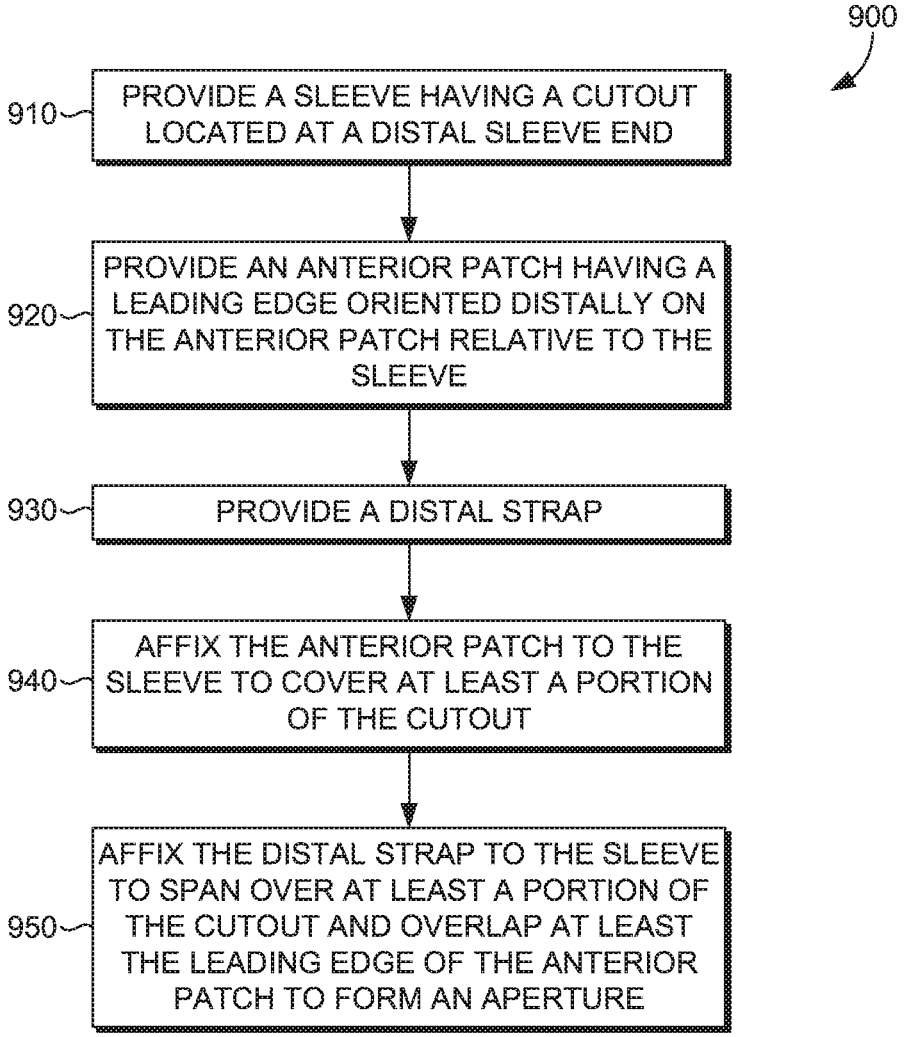
FIG. 13 depicts a flow diagram illustrating a method of manufacturing a sleeve having a sleeve cuff with an aperture for receiving a thumb, in accordance with an aspect described herein.

FIG. 13 depicts a method 900 of manufacturing a sleeve having a sleeve cuff for receiving a thumb through an aperture. Initially, the method 900 of manufacturing a sleeve 210 having a sleeve cuff 100 involves providing a sleeve 210, the sleeve 210 having a cutout 240 located at a distal sleeve end 230, as depicted at block 910. In one aspect, the distal sleeve end 230 is distally located from the wearer's torso when the sleeve is in an as-worn position, the distal sleeve end 230 presents a hand opening allowing a hand of the wearer to communicate through the interior of the sleeve, and the sleeve 210 further including a cutout 240 formed through a sleeve wall 232 of the sleeve, and the cutout 240 having at least one cutout edge 250.

The method 900 further comprises the step of providing an anterior patch 300 having a leading edge 310 oriented distally on the anterior patch 300 relative to the sleeve 210, as depicted in block 920. In one aspect, the anterior patch 300 includes a plurality of trailing edges 320. The plurality of trailing edges 320 on the anterior patch 300 are located proximally from the leading edge 310.

The method 900 further comprises the step of providing a distal strap 400, as depicted in block 930. In an exemplary aspect, the distal strap 400 includes a trailing edge 410 and a plurality of leading edges 420. The distal strap 400 is oriented relative to the sleeve 210 to have the trailing edge 410 located proximally from the plurality of leading edges 420.

The method 900 further comprises the step of affixing the anterior patch 300 to the sleeve 210 to cover at least a portion of the cutout 240, as depicted in block 940. In an aspect, the anterior patch 300 is affixed to the sleeve 210 at the plurality of trailing edges 320.

The method 900 further comprises the step of affixing the distal strap 400 to the sleeve 210 to span over at least a portion of the cutout 240 and overlap at least the leading edge 310 of the anterior patch 300 to form an aperture 110, as depicted in block 950. In an aspect, the distal strap 400 is affixed to the sleeve 210 at the plurality of leading edges 420. In an aspect, the plurality of leading edges 420 are affixed proximate to the distal sleeve end 230 and extend proximally up the sleeve 210 to the distal strap trailing edge 410.

Other aspects of a tubular sleeve will now be described in reference to FIGS. 14-22. The tubular sleeve described herein may relate to a sleeve affixed to, or integral in, a garment (e.g., a shirt). The tubular sleeve described herein may also relate to a stand-alone garment (e.g., a sleeve configured to enclose at least a portion of an arm of a wearer).

Figure 14:
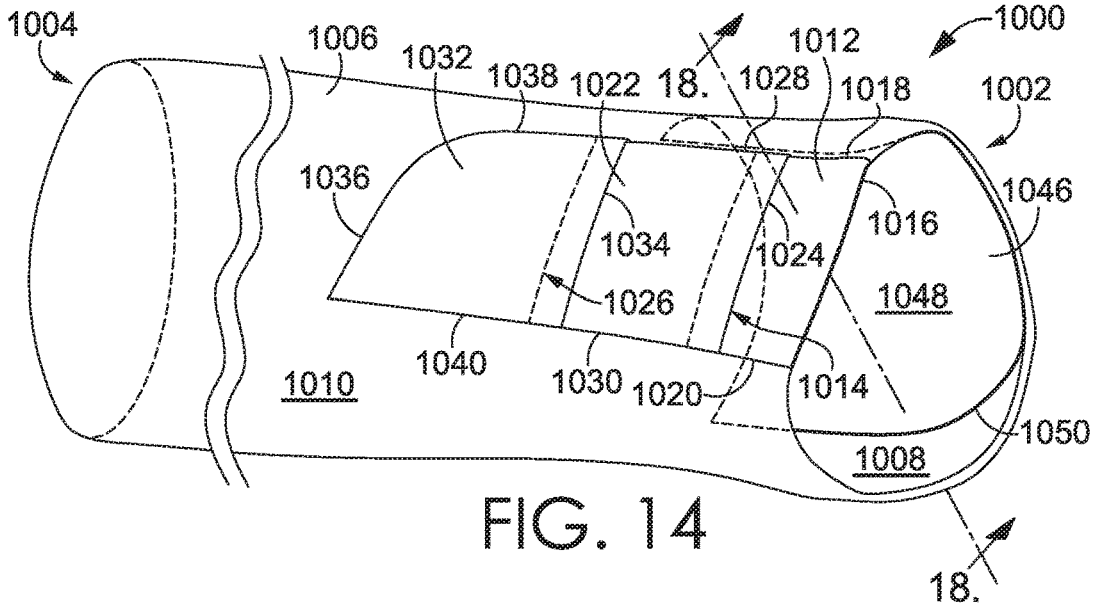
FIG. 14 illustrates a detail view of a sleeve cuff in a closed configuration in accordance with an aspect described herein.

Referring initially to FIG. 14, a tubular sleeve 1000 may comprise a cylindrical wall 1006 extending between a distal end 1002 and a proximal end 1004 and may enclose an interior volume. The cylindrical wall 1006 may include an inner surface 1008 enclosing the interior volume. Opposite the inner surface 1008 is an outer surface 1010.

A cutout (such as cutout 240 shown in FIGS. 2A and 2B) may be formed proximate the distal end 1002 and extend through the cylindrical wall 1006 from the outer surface 1010 to the inner surface 1008. The cutout may be defined by one or more cutout edges. For example, the cutout 240 illustrated in FIG. 2A includes three cutout edges, namely the first cutout edge 242, the second cutout edge 244 and the rear cutout edge 246. The first cutout edge 242 is spaced across the cutout 240 from the second cutout edge 244. It is contemplated that any number of cutout edges may surround the cutout. It is further contemplated that the cutout may be formed through the cylindrical wall 1006 proximally up the tubular sleeve 1000, and spaced apart, from the distal end 1002, in accordance with some aspects.

Returning to FIG. 14, the tubular sleeve 1000 may further comprise a first panel 1012, a second panel 1022 and a third panel 1032. Each of the first panel 1012, the second panel 1022 and the third panel 1032 may be affixed to the tubular sleeve 1000 to span a portion of the cutout and partially overlap an adjacent panel. The first panel 1012 may include a trailing edge 1014, a leading edge 1016, a first side edge 1018 and a second side edge 1020. The leading edge 1016 of the first panel 1012 defines at least a portion of a distalmost edge of the tubular sleeve 1000 when the tubular sleeve 1000 is fully extended. Similarly, the second panel 1022 may include a leading edge 1024, a trailing edge 1026, a first side edge 1028 and a second side edge 1030. Likewise, the third panel 1032 may include a leading edge 1034, a trailing edge 1036, a first side edge 1038 and a second side edge 1040. In some aspects, the first and second side edges of each panel are the same length. In other aspects, the first and second side edges of each panel are parallel to one another.

Similar to the panels described above (e.g., the anterior patch and the distal strap), the first panel 1012, the second panel 1022 and the third panel 1032 may have any number of edges so long as the first panel 1012 has at least the first-panel trailing edge 1014, the second panel 1022 has at least the second-panel leading edge 1024 and the second-panel trailing edge 1026 and the third panel 1032 has at least the third-panel leading edge 1034, in accordance with some aspects. For example, the first panel 1012 may have an irregular shape or a different shape than that which is depicted in FIG. 14 (i.e., a rectangle). In other aspects, the first-panel leading edge 1016, the first-panel trailing edge 1014, the second-panel leading edge 1024, the second-panel trailing edge 1026, and the third-panel leading edge are parallel to one another. In still other aspects, at least one of the first-panel leading edge 1016, the first-panel trailing edge 1014, the second-panel leading edge 1024, the second-panel trailing edge 1026, and the third-panel leading edge is parallel to the distal end 1002 of the tubular sleeve 1000.

In the illustrated aspect of FIG. 14, the first-panel first side edge 1018, the second-panel first side edge 1028 and the third-panel first side edge 1038 are each affixed to the tubular sleeve 1000 along the first cutout edge (best seen in FIG. 2A). Likewise, the first-panel second side edge 1020, the second-panel second side edge 1030 and the third-panel second side edge 1040 are each affixed to the tubular sleeve 1000 along the second cutout edge (best seen in FIG. 2A), in accordance with the illustrated aspect. In some aspects, the first side edges 1018, 1028 and 1038 of the panels may each be affixed to the tubular sleeve 1000 at a first seam and the second side edges 1020, 1030 and 1040 of the panels may each be affixed to the tubular sleeve 1000 at a second seam. The first seam and the second seam may join the panels to the tubular sleeve 1000 at the first cutout edge and the second cutout edge. In other aspects, the first side edges 1018, 1028 and 1038 and the second side edges 1020, 1030 and 1040 may be affixed to the outer surface 1010 of the tubular sleeve 1000. For example, the first-panel first side edge 1018 may extend around the tubular sleeve 1000 past the first cutout edge and may be affixed to the outer surface 1010. In other aspects, one or more of the first panel 1012, the second panel 1022, and the third panel 1032 may integrally extend from the tubular sleeve 1000. In other words, a knitting or weaving process used to form the tubular sleeve 1000 may be modified to form the first, second and third panels 1012, 1022, and 1032 such that there are no seams (e.g., seamless construction).

In the illustrated aspect, the second panel 1022 overlaps the first panel 1012 such that the second-panel leading edge 1024 is positioned closer to the distal end 1002 of the tubular sleeve 1000 than the first-panel trailing edge 1014 across the entire width of the cutout. Likewise, the third panel 1032 overlaps the second panel 1022 such that the third-panel leading edge 1034 is positioned closer to the distal end 1002 of the tubular sleeve 1000 than the second-panel trailing edge 1026 across the entire width of the cutout.

Figure 17:
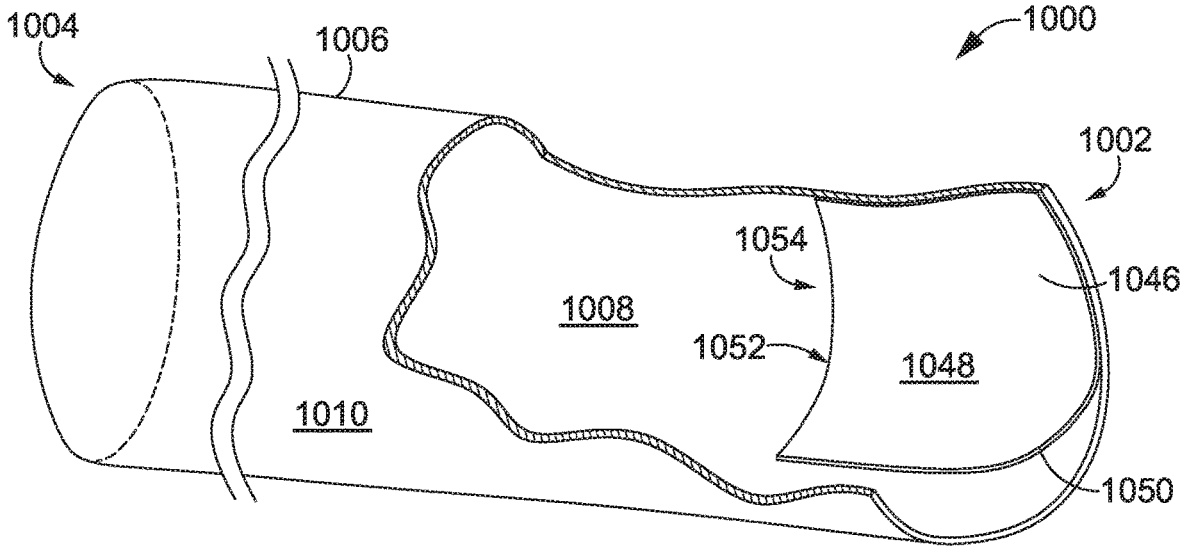
FIG. 17 illustrates a detail view of an interior portion of a sleeve cuff in a first opened configuration in accordance with an aspect described herein.
Figure 18:
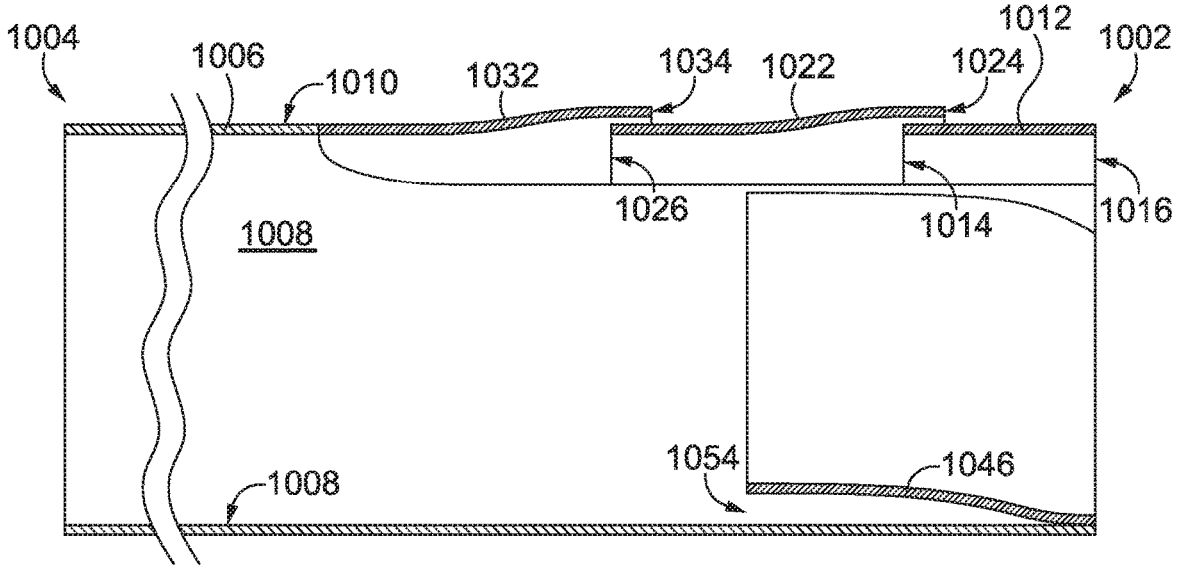
FIG. 18 depicts a cross-section view taken along cut line 18-18 of FIG. 14 and illustrates a sleeve cuff in accordance with an aspect described herein.

Turning to FIGS. 17 and 18, a mitten 1046 may be affixed to the inner surface 1008 of the tubular sleeve 1000 and may optionally receive a portion of the hand and/or digits of a wearer when the tubular sleeve 1000 is in the as-worn position (i.e., when the tubular sleeve 1000 is donned by a wearer). In some aspects, the mitten 1046 comprises a panel 1048 having a perimeter 1050. The panel 1048 may be affixed to the inner surface 1008 along a portion of the perimeter 1050 while an unaffixed portion 1052 may present an aperture 1054 for communication into the mitten 1046. The mitten 1046 may be oriented such that the aperture 1054 opens towards the proximal end 1004 of the tubular sleeve 1000. In other aspects, the mitten 1046 may comprise another enclosure affixed within the interior volume of the tubular sleeve 1000 and configured to receive a portion of a wearer's hand and/or digits. For instance, instead of a mitten, a glove-like structure may be affixed within the interior volume of the tubular sleeve 1000, where the glove-like structure has one or more compartments for receiving individual digits of the wearer. The mitten 1046 may be positioned proximate to the distal end 1002 of the tubular sleeve 1000, in accordance with some aspects.

The tubular sleeve 1000 may be worn in a variety of configurations, as illustrated in FIGS. 14-16 and 19-22. FIG. 14 depicts the tubular sleeve 1000 in a closed configuration. In the closed configuration a distal thumbhole 1042 (shown in FIG. 15) and a proximal thumbhole 1044 (shown in FIG. 16) are both closed. In other words, the second-panel leading edge 1024 is located proximally to the first-panel trailing edge 1014 across the entire width of the cutout and the third-panel leading edge 1034 is located proximally to the second-panel trailing edge 1026 across the entire width of the cutout when the tubular sleeve 1000 is in the closed configuration.

Figure 15:
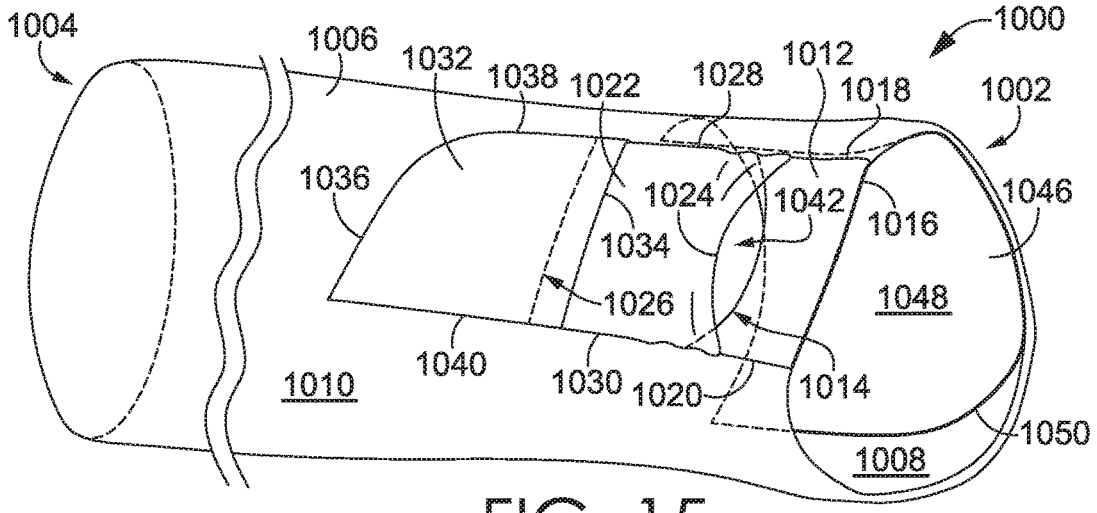
FIG. 15 illustrates a detail view of a sleeve cuff in a first opened configuration in accordance with an aspect described herein.
Figure 19:
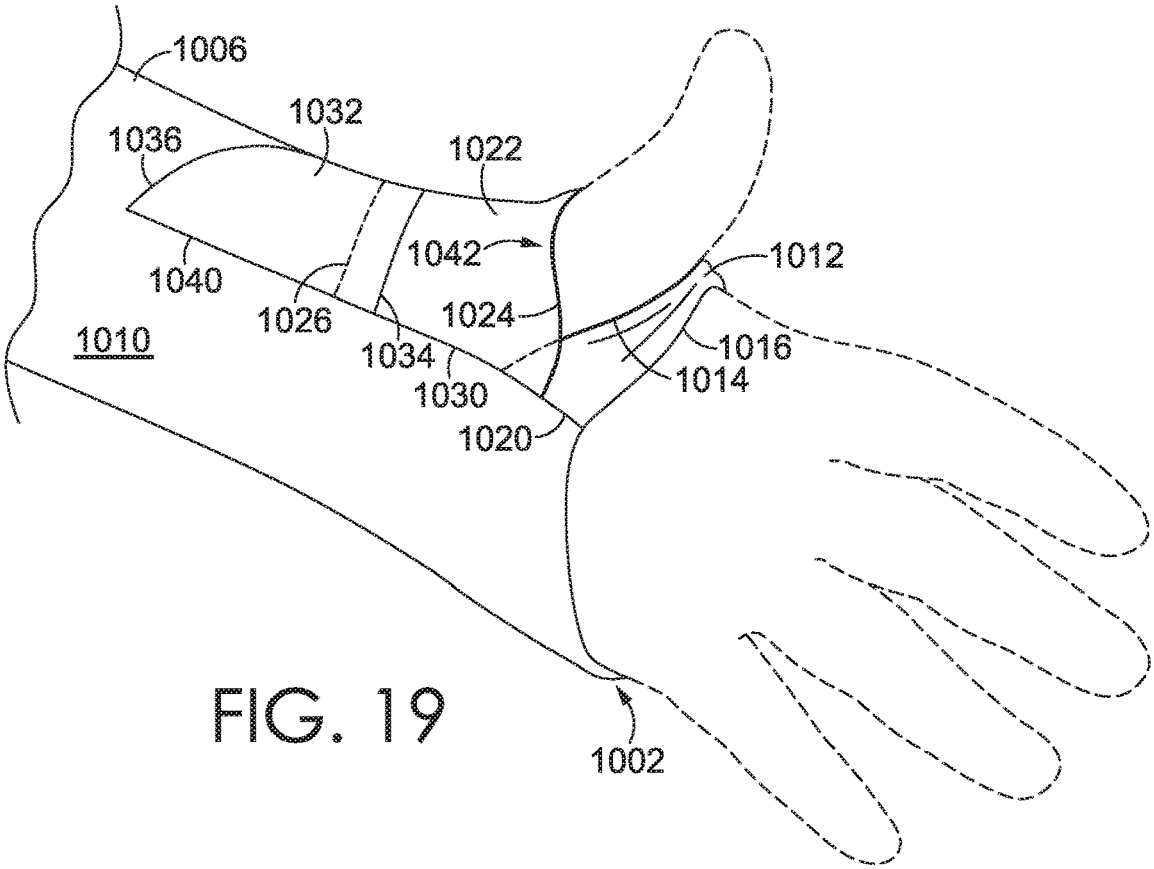
FIG. 19 illustrates a detail view of a sleeve cuff having a thumb extending through a distal aperture in accordance with an aspect described herein.
Figure 20:
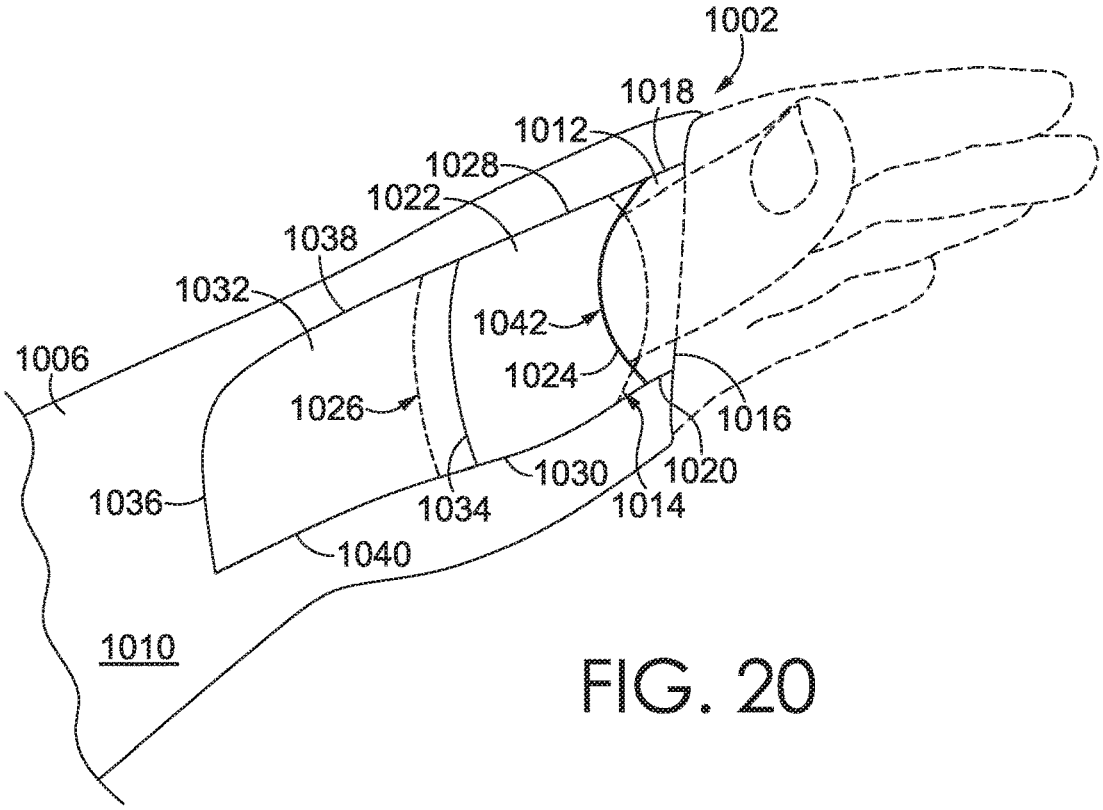
FIG. 20 illustrates a detail view of a sleeve cuff having a thumb extending through a distal aperture in accordance with an aspect described herein.

Referring to FIGS. 15, 19 and 20, the tubular sleeve 1000 is depicted in a first open configuration. In the first open configuration, a wearer's thumb is received from the interior volume and is communicated through the distal thumbhole 1042 while a portion of the wearer's hand and/or digits extend distally past the distal end 1002 of the tubular sleeve 1000. When a thumb is received through the distal thumbhole 1042, the first-panel trailing edge 1014 is displaced distally and the second-panel leading edge 1024 is displaced proximally such that the second-panel leading edge 1024 may not be distally located relative to the first-panel trailing edge 1014 across the entire width of the cutout. In some aspects, the first open configuration may be similar to the open configuration disclosed above in reference to FIGS. 5-7.

Figure 16:
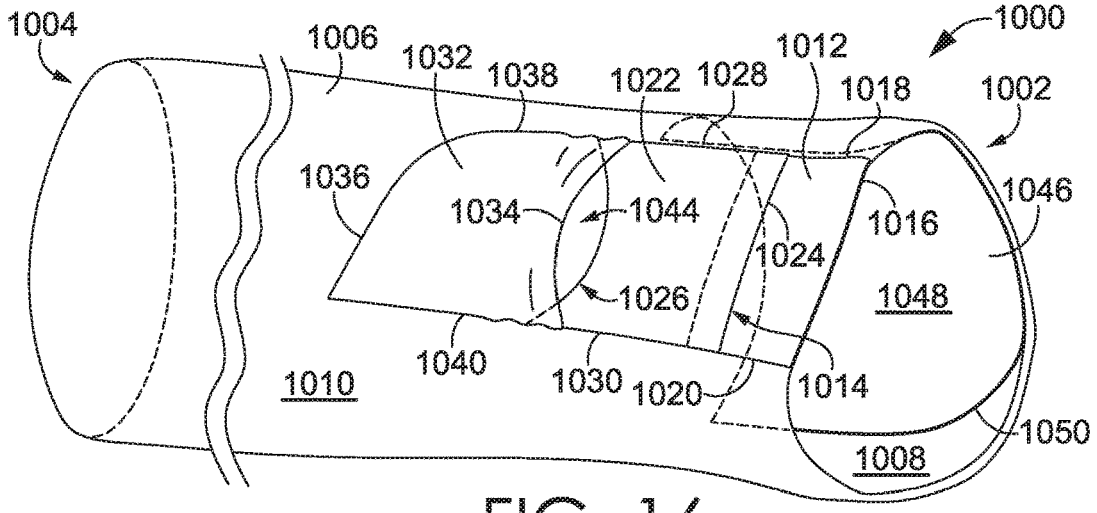
FIG. 16 illustrates a detail view of a sleeve cuff in a second opened configuration in accordance with an aspect described herein.
Figure 21:
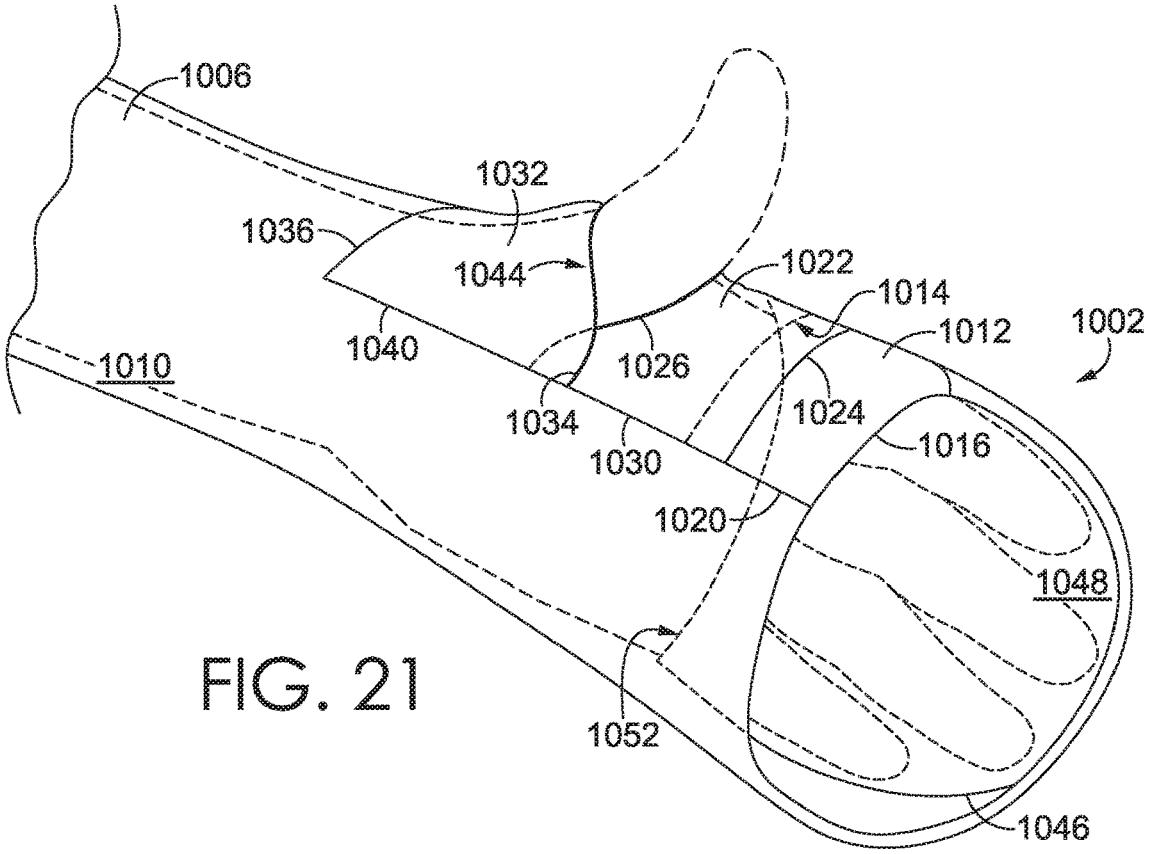
FIG. 21 illustrates a detail view of a sleeve cuff having a thumb extending through a proximal aperture in accordance with an aspect described herein.
Figure 22:
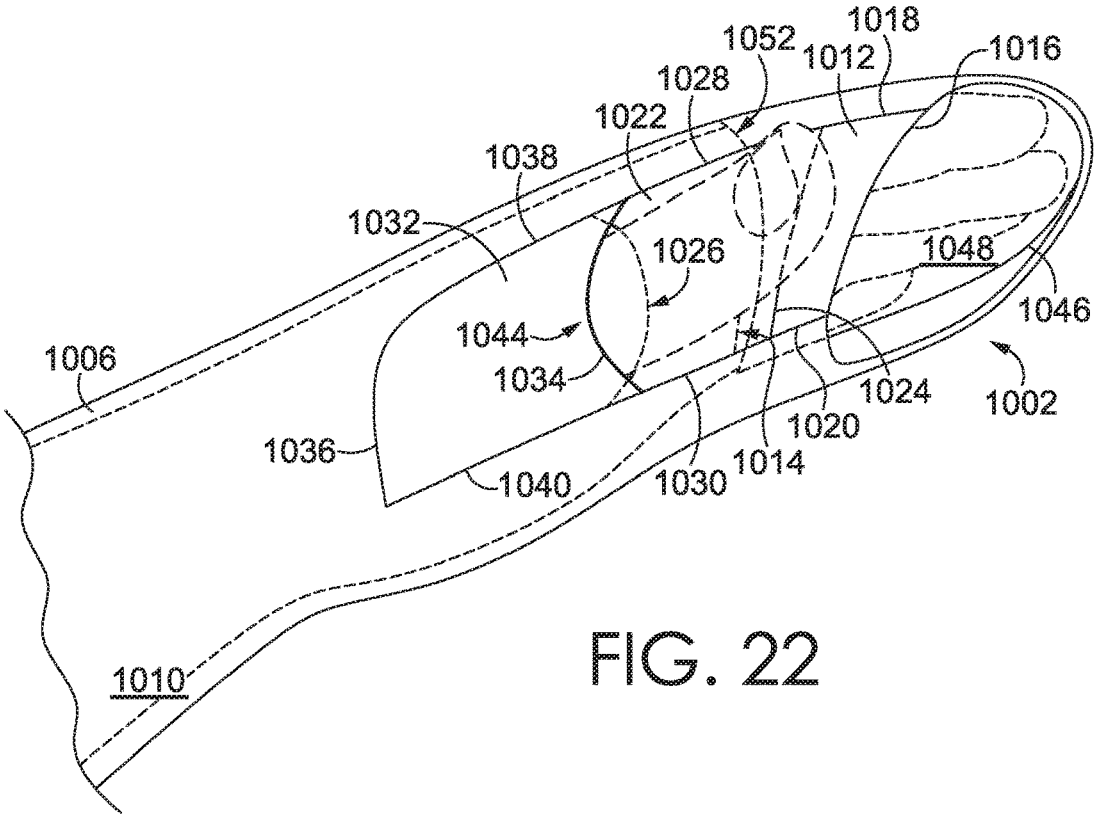
FIG. 22 illustrates a detail view of a sleeve cuff having a thumb extending through a proximal aperture in accordance with an aspect described herein.

Referring to FIGS. 16, 21 and 22, the tubular sleeve 1000 is depicted in a second open configuration. In the second open configuration, the wearer's thumb is received from the interior volume and is communicated through the proximal thumbhole 1044 while a portion of the wearer's hand and/or digits extend through the aperture 1054 (shown in FIG. 18) and into the mitten 1046. When a thumb is received through the proximal thumbhole, the second-panel trailing edge 1026 is displaced distally and the third-panel leading edge 1034 is displaced proximally such that the third-panel leading edge 1034 may not be distally located relative to the second-panel trailing edge 1026 across the entire width of the cutout.

As seen, the location of the proximal thumbhole 1044 is selected to provide easy access to the wearer's thumb when the wearer chooses to position his or her hand in the mitten 1046. Similarly, the location of the distal thumbhole 1042 is selected to provide easy access to the wearer's thumb when the wearer chooses to not position his or hand in the mitten 1046 and, instead, extends their hand through the distal end 1002 of the tubular sleeve 1000. In other words, the positioning of the thumbholes 1042 and 1044 is selected to reduce unnecessary fabric strain on the sleeve material and to reduce uncomfortable tensioning forces on the wearer's thumb. Although the proximal and distal thumbholes 1044 and 1042 are shown as being used in conjunction with the mitten 1046, it is contemplated herein that the tubular sleeve 1000 may not include a mitten 1046. In this case, the proximal thumbhole 1044 may be used when the wearer wishes to have a greater extent of the sleeve 1000 extend over the wearer's hand, and the distal thumbhole 1042 may be used when the wearer wishes to fully extend the wearer's hand through the distal end 1002 of the sleeve 1000. Any and all aspects, and any variation thereof, are contemplated as being within aspects herein.

From the foregoing, it will be seen that aspects described herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects described herein may be made without departing from the scope thereof, it is to be understood that all matter herein set forth or shown in the accompanying drawings is to be interpreted as illustrative and not in a limiting sense.

What is claimed is:

1. A tubular sleeve comprising:

a distal end opposite a proximal end;

a cutout formed through the tubular sleeve proximate the distal end, the cutout defined in part by a first cutout edge and a second cutout edge, wherein the first cutout edge is positioned across the cutout from the second cutout edge;

a first panel having at least a trailing edge and a leading edge, the leading edge defining at least a portion of a distalmost edge of the tubular sleeve when the tubular sleeve is fully extended, the first panel affixed to the first cutout edge with a first seam portion and to the second cutout edge with a second seam portion to span a first portion of the cutout;

a second panel having at least a leading edge and a trailing edge, the second panel affixed to the first cutout edge and to the second cutout edge to span a second portion of the cutout, the second panel leading edge overlapping the first panel trailing edge to define at least a portion of a first aperture, the first aperture being in communication with an interior volume of the tubular sleeve; and a third panel having at least a leading edge, the third panel affixed to the first cutout edge and to the second cutout edge to span a third portion of the cutout, the third panel leading edge overlapping the second panel trailing edge to define at least a portion of a second aperture, the second aperture being in communication with the interior volume of the tubular sleeve.

2. The tubular sleeve of claim 1 further comprising:

an inner surface defining the interior volume of the tubular sleeve; and a mitten affixed to the inner surface.

3. The tubular sleeve of claim 1, wherein the first panel trailing edge is parallel to the distalmost edge of the tubular sleeve.

4. The tubular sleeve of claim 1 further comprising:

each of the first panel, the second panel, and the third panel having a first side edge affixed to the first cutout edge and a second side edge affixed to the second cutout edge.

5. The tubular sleeve of claim 4, wherein each respective first side edge of the first panel, the second panel and the third panel is the same length as the respective second side edge of the first panel, the second panel and the third panel.

6. The tubular sleeve of claim 1 further comprising a cylindrical wall extending from the distal end to the proximal end, wherein at least one of the first panel, the second panel, and the third panel is integral to the cylindrical wall and extends from the first cutout edge to the second cutout edge.

7. A tubular sleeve comprising:

a distal end opposite a proximal end;

a cutout formed through the tubular sleeve proximate to the distal end, the cutout defined in part by a first cutout edge and a second cutout edge, wherein the first cutout edge is positioned across the cutout from the second cutout edge;

a first panel having at least a first side edge, a second side edge, a leading edge and a trailing edge, the leading edge defining at least a portion of a distalmost edge of the tubular sleeve when the tubular sleeve is fully extended, the first side edge affixed at a first seam extending along the first cutout edge, the second side edge affixed at a second seam extending along the second cutout edge;

a second panel having at least a first side edge, a second side edge, a leading edge and a trailing edge, the second panel first side edge affixed at the first seam and the second panel second side edge affixed at the second seam such that the leading edge of the second panel overlaps the trailing edge of the first panel; and a third panel having at least a first side edge, a second side edge and a leading edge, the third panel first side edge affixed at the first seam and the third panel second side edge affixed at the second seam such that the leading edge of the third panel overlaps the trailing edge of the second panel.

8. The tubular sleeve of claim 7, wherein the first panel first side edge is the same length as the first panel second side edge.

9. The tubular sleeve of claim 7, wherein the second panel leading edge extends in parallel to the second panel trailing edge.

10. The tubular sleeve of claim 7, wherein the entire cutout is covered by the first panel, the second panel, and the third panel.

11. A tubular sleeve comprising:

a cylindrical wall extending axially from a proximal end to a distal end, the cylindrical wall having an inner surface enclosing an interior volume and an outer surface opposite the inner surface;

a cutout extending through a portion of the cylindrical wall from the outer surface to the inner surface, proximate to the distal end, the cutout defined in part by a first cutout edge and a second cutout edge, wherein the first cutout edge is positioned across the cutout from the second cutout edge;

a first panel spanning the cutout and having at least a trailing edge and a leading edge, the leading edge defining at least a portion of a distalmost edge of the tubular sleeve when the tubular sleeve is fully extended, the first panel affixed to the cylindrical wall at the first cutout edge with a first seam and at the second cutout edge with a second seam;

a second panel spanning the cutout and having at least a leading edge and a trailing edge, the second panel affixed to the cylindrical wall such that the leading edge of the second panel overlaps the trailing edge of the first panel and defines at least a portion of a distal thumbhole;

a third panel spanning the cutout and having at least a leading edge, the third panel affixed to the cylindrical wall such that the leading edge of the third panel overlaps the trailing edge of the second panel and defines at least a portion of a proximal thumbhole; and a mitten affixed to the inner surface proximate the distal end of the tubular sleeve.

12. The tubular sleeve of claim 11 further comprising:

the mitten comprising a panel having a perimeter, the panel being affixed to the inner surface along a portion of the perimeter and unaffixed along another portion of the perimeter, the unaffixed portion of the perimeter presenting an aperture allowing communication with an interior portion of the mitten.

13. The tubular sleeve of claim 12, wherein the aperture is open towards the proximal end of the tubular sleeve.

14. The tubular sleeve of claim 11, wherein the proximal and distal thumbholes are each configured to move between a closed configuration and an open configuration.

15. The tubular sleeve of claim 14, wherein the closed configuration of the distal thumbhole comprises the second panel leading edge overlapping at least a portion of the first panel across an entire width of the cutout.

16. The tubular sleeve of claim 14, wherein the closed configuration of the proximal thumbhole comprises the third panel overlapping at least a portion of the second panel across an entire width of the cutout.

17. The tubular sleeve of claim 14, wherein the cutout has a first cutout edge opposite a second cutout edge.

18. The tubular sleeve of claim 17, wherein the open configuration of the distal thumbhole comprises the second panel leading edge overlapping a portion of the first panel from the first cutout edge to a first point of intersection and from the second cutout edge to a second point of intersection, the first and second points of intersection both being between the first and second cutout edges.

19. The tubular sleeve of claim 17, wherein the open configuration of the proximal thumbhole comprises the third panel leading edge overlapping a portion of the second panel from the first cutout edge to a first point of intersection and from the second cutout edge to a second point of intersection, the first and second points of intersection both being between the first and second cutout edges.

* * * * *